US005407132A

United States Patent [19]

Messerly et al.

[11] Patent Number: 5,407,132

[45] Date of Patent: Apr. 18, 1995

[54] METHOD AND APPARATUS FOR SPRAYING VISCOUS ADHESIVES

[75] Inventors: James W. Messerly, Stow; James C. Smith, Amherst; Laurence B. Saidman, Avon Lake, all of Ohio

[73] Assignee: Nordson Corporation, Westlake, Ohio

[21] Appl. No.: 139,457

[22] Filed: Oct. 20, 1993

[51] Int. Cl.[6] ..... B05B 1/24; B05B 9/03; B01E 7/00

[52] U.S. Cl. ..... 239/124; 239/135; 239/142; 239/398; 366/326

[58] Field of Search ..... 239/8–10, 239/124, 135, 142, 398, 399; 366/326

[56] References Cited

U.S. PATENT DOCUMENTS

| | | | |
|---|---|---|---|
| 328,134 | 10/1885 | McKay | 366/326 X |
| 1,483,225 | 2/1924 | Hammett | 73/861.92 |
| 1,511,765 | 10/1924 | Latham | 73/861.92 |
| 1,585,255 | 5/1926 | McFadden | 73/861.92 |
| 2,592,481 | 4/1952 | Spencer et al. | 366/326 X |
| 2,862,511 | 12/1958 | Forsberg | 366/326 X |
| 3,229,077 | 1/1966 | Gross | 364/510 |
| 3,429,480 | 2/1969 | Petyt | 222/26 |
| 3,651,989 | 3/1972 | Westrich | 222/14 |
| 3,751,644 | 8/1973 | Mayer | 364/502 |
| 3,764,069 | 10/1973 | Runstadler, Jr. et al. | 239/8 |
| 3,777,935 | 12/1973 | Storey | 222/16 |
| 3,921,901 | 11/1975 | Woodman | 239/13 |
| 3,967,634 | 7/1976 | Scherer | 137/99 |
| 4,019,653 | 4/1977 | Scherer | 222/1 |
| 4,046,287 | 9/1977 | Hoekstra | 222/16 |
| 4,059,466 | 11/1977 | Scholl et al. | 156/78 |
| 4,059,714 | 11/1977 | Scholl et al. | 156/78 X |
| 4,116,364 | 9/1978 | Culbertson | 222/40 |
| 4,156,754 | 5/1979 | Cobbs, Jr. et al. | 156/78 X |
| 4,193,745 | 3/1980 | Hamilton et al. | 366/272 X |
| 4,200,207 | 4/1980 | Akers et al. | 222/190 |
| 4,247,581 | 1/1981 | Cobbs, Jr. et al. | 427/373 |
| 4,259,402 | 3/1981 | Cobbs, Jr. et al. | 428/317.5 |
| 4,265,858 | 5/1981 | Crum et al. | 425/200 |
| 4,288,741 | 9/1981 | Dechene et al. | 324/664 |
| 4,301,119 | 11/1981 | Cobbs, Jr. et al. | 422/133 |
| 4,350,266 | 9/1982 | Hetherington | 222/40 |
| 4,371,096 | 2/1983 | Scholl et al. | 418/15 X |
| 4,405,063 | 9/1983 | Wydro et al. | 222/146.5 |
| 4,423,161 | 12/1983 | Cobbs, Jr. et al. | 521/73 |
| 4,483,463 | 11/1984 | Buschmann | 222/64 |
| 4,505,405 | 3/1985 | Kelly | 222/135 |
| 4,505,406 | 3/1985 | Cobbs, Jr. et al. | 222/135 |
| 4,505,957 | 3/1985 | Cobbs, Jr. et al. | 427/422 |
| 4,516,725 | 5/1985 | Cavanaugh | 239/127 |
| 4,522,789 | 6/1985 | Kelly et al. | 422/234 X |
| 4,527,712 | 7/1985 | Cobbs, Jr. et al. | 222/1 |
| 4,553,701 | 11/1985 | Rehman et al. | 239/432 |
| 4,601,645 | 7/1986 | Schmitkons | 239/432 |
| 4,630,774 | 12/1986 | Rehman et al. | 239/8 |

(List continued on next page.)

FOREIGN PATENT DOCUMENTS

| | | |
|---|---|---|
| 0246797 | 11/1987 | European Pat. Off. . |
| 0259689 | 3/1988 | European Pat. Off. . |
| 0321607 | 6/1989 | European Pat. Off. . |
| 0350909 | 1/1990 | European Pat. Off. . |
| 0350910 | 1/1990 | European Pat. Off. . |
| 0388927 | 3/1990 | European Pat. Off. . |
| 0388915 | 9/1990 | European Pat. Off. . |
| 0388916 | 9/1990 | European Pat. Off. . |
| 0388923 | 9/1990 | European Pat. Off. . |

*Primary Examiner*—Andres Kashnikow
*Assistant Examiner*—Lesley D. Morris
*Attorney, Agent, or Firm*—Holland & Knight

[57] ABSTRACT

A method and apparatus for spraying adhesive compositions having a high solids content comprises a source of supercritical fluid diluent such as supercritical carbon dioxide, a source of virgin adhesive, an adhesive dispenser and a mixer communicating with each source of material and with the dispenser. The mixer includes a dynamic mixing element which agitates the viscous adhesive material allowing the supercritical carbon dioxide to be effectively dispersed into the adhesive, thus forming an adhesive composition with a high solids content having a relatively low viscosity suitable for spray application of the adhesive.

12 Claims, 1 Drawing Sheet

U.S. PATENT DOCUMENTS

| | | | |
|---|---|---|---|
| 4,632,314 | 2/1986 | Smith et al. | 239/433 |
| 4,654,802 | 3/1987 | Davis | 364/502 |
| 4,705,461 | 11/1987 | Clements | 417/387 |
| 4,717,582 | 1/1988 | Kotoye et al. | 118/688 X |
| 4,734,451 | 3/1988 | Smith | 524/493 |
| 4,778,631 | 10/1988 | Cobbs, Jr. et al. | 261/128 |
| 4,779,762 | 10/1988 | Klein et al. | 222/52 |
| 4,882,107 | 11/1989 | Cavender et al. | 264/51 |
| 5,027,742 | 7/1991 | Lee et al. | 118/300 |
| 5,057,342 | 10/1991 | Hoy et al. | 427/422 |
| 5,058,805 | 10/1991 | Anderson et al. | 239/124 X |
| 5,088,443 | 2/1992 | Hastings et al. | 118/314 |
| 5,098,194 | 3/1992 | Kuo et al. | 366/144 |
| 5,106,659 | 4/1992 | Hastings et al. | 427/421 |
| 5,141,156 | 8/1992 | Hoy et al. | 239/135 |
| 5,197,800 | 3/1993 | Saidman et al. | 239/8 X |
| 5,203,843 | 4/1993 | Hoy et al. | 239/135 |
| 5,211,342 | 5/1993 | Hoy et al. | 239/135 X |

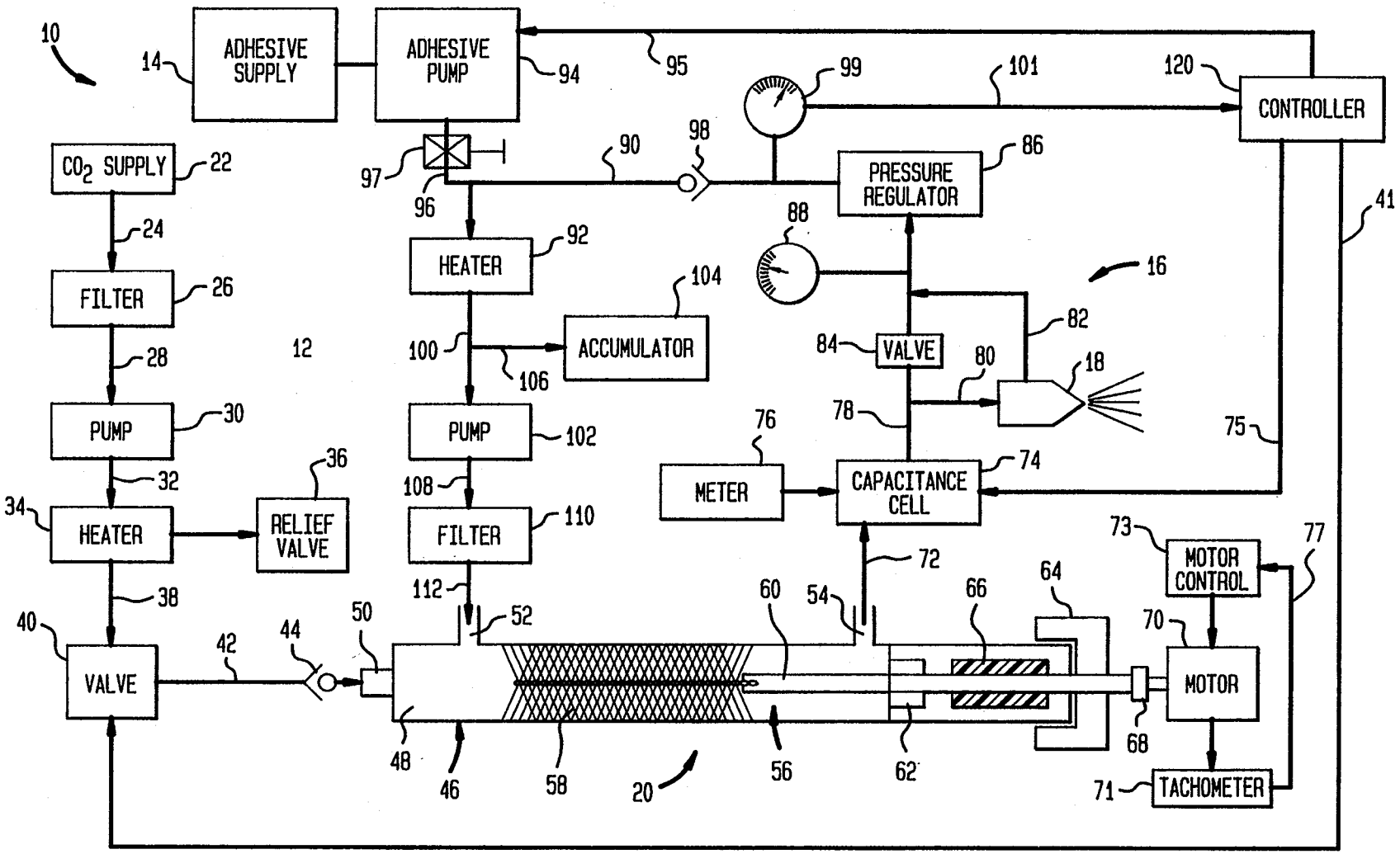
CONTROLLER
ADHESIVE PUMP
ADHESIVE SUPPLY
$CO_2$ SUPPLY
FILTER
PUMP
HEATER
VALVE
RELIEF VALVE
HEATER
PUMP
FILTER
ACCUMULATOR
PRESSURE REGULATOR
VALVE
CAPACITANCE CELL
METER
MOTOR CONTROL
MOTOR
TACHOMETER

METHOD AND APPARATUS FOR SPRAYING VISCOUS ADHESIVES

FIELD OF THE INVENTION

This invention relates to a method and apparatus for dispensing viscous adhesives, and, more particularly, to a method and apparatus for dynamically mixing adhesives having a relatively high solids content with supercritical carbon dioxide as a fluid diluent to form an adhesive composition which can be sprayed at comparatively low pressures.

BACKGROUND OF THE INVENTION

Adhesives have been utilized for decades to bind a wide variety of materials together, and new applications for adhesives are being developed on a continuing basis. Compared to mechanical fastening devices, adhesives are capable of distributing stresses over wider surface areas and provide superior strength-to-weight ratios and dimensional stability for a variety of finished products.

A large portion of the adhesives utilized in industrial and commercial applications contain organic solvents and/or nonaqueous diluents which function to reduce the viscosity of the adhesives to facilitate their application. A variety of application methods are employed in industry, such as brushing, rolling, dipping and the like, but spraying of adhesive in atomized droplets is often the most desirable particularly when adhering materials such as paper, cardboard, wood, leather, plastic, cloth and rubber. A growing concern with the application of adhesives containing organic solvents or nonaqueous diluents, particularly when employing the spraying method of application, is the environmental hazards occasioned by the release of organic solvent vapors to atmosphere during the application procedure. The escaping solvents can contaminate the surrounding atmosphere and create injury to the personnel involved in the application operation. Additionally, since most solvents react with oxidants, pollution problems of toxicity, odor and smog may be created.

While it may be possible to simply reduce the organic solvent and/or nonaqueous diluent content of certain adhesives, such a reduction generally increases the viscosity of the resulting adhesive composition to such an extent that it can no longer be sprayed using conventional techniques, i.e. air spray, airless spray and air-assisted, airless spray. Even if such highly viscous adhesive compositions are capable of being sprayed, the pressure required to convey and transmit the adhesive through an adhesive dispenser to obtain successful atomization is very high. In some cases, even at high application pressures, the adhesive layer resulting from spraying viscous adhesive compositions does not have enough solvent present to allow for sufficient flow out of the adhesive where a continuous, uniform adhesive coating is desired.

These problems have been addressed in U.S. Pat. No. 5,066,522 to Cole, et al., in which it is suggested that at least a portion of the organic solvents and/or nonaqueous diluents in conventional adhesive compositions be replaced with a supercritical fluid as a diluent. As discussed in U.S. Pat. No. 5,066,522, supercritical carbon dioxide has been found to be an acceptable replacement for a substantial portion of the organic solvents or nonaqueous diluents currently utilized in many adhesive compositions. The presence of supercritical carbon dioxide in solution with the adhesive reduces the environmental hazards created by the escape of solvents, enhances curing of the adhesive for certain types of adhesive materials, and often avoids the formation of "cobwebs" or elongated, thin strands of adhesive which may be produced during spraying operations with conventional adhesive formulations. The problem of cobwebs is eliminated because of the explosive atomization created when the supercritical carbon dioxide is released from solution upon exposure of the pressurized solution to atmosphere.

A batch type system and a continuous supply system are disclosed in U.S. Pat. No. 5,066,522, and one or the other is employed depending upon the requirements of the particular application. The effectiveness of each of these systems in spraying an acceptable coating or layer of viscous adhesive onto a substrate is dependent, at least in part, on the effectiveness with which the virgin adhesive and supercritical carbon dioxide are intermixed to form an adhesive composition wherein the supercritical carbon dioxide is dissolved or dispersed in solution with the adhesive. In both the batch type and continuous supply systems disclosed in U.S. Pat. No. 5,066,522, the supercritical carbon dioxide and adhesive are combined within a static mixer located at a position downstream from the sources of both materials. It has been found that static mixers are ineffective in obtaining complete admixture of the supercritical carbon dioxide and adhesive especially when the virgin adhesive has a high solids content, i.e. on the order of at least about 20% to 30% solids.

The problem with static mixers is particularly evident when attempting to spray rubber-based cements, especially when carbon gels are present. These types of adhesives contain "bound rubbers" which means that the rubber and solvent components of the adhesive form a suspension or dispersion as opposed to a solution. Most bound rubber adhesives use heptane as a solvent to reduce their viscosity. When these types of adhesives are passed through a static mixer with supercritical carbon dioxide, the heptane preferentially dissolves into the supercritical carbon dioxide, leaving the rubber component. The result is pockets of highly solvated supercritical carbon dioxide in a thick, high viscosity rubber, which cannot be effectively sprayed.

SUMMARY OF THE INVENTION

It is therefore among the objectives of this invention to provide a method and apparatus for spraying highly viscous adhesives, such as bound rubber adhesives, which produces an adhesive composition which is readily sprayable at comparatively low pressure, and which is simple in construction and operation.

These objectives are accomplished in an apparatus for spraying adhesive compositions having a high solids content comprising a source of fluid diluent such as supercritical carbon dioxide, a source of virgin adhesive, an adhesive dispenser and a mixer communicating with each source of material and with the dispenser. The mixer includes a dynamic mixing element which agitates the viscous adhesive material allowing the supercritical carbon dioxide to be dissolved or dispersed into solution with the adhesive material, thus forming an adhesive composition having a high solids content and relatively low viscosity.

In the case of bound rubber adhesives, the dynamic mixer breaks down the carbon gel of the rubber so that the supercritical carbon dioxide becomes mixed in and penetrates the interstices of the rubber before the heptane solvent component of the rubber dissolves into the supercritical carbon dioxide. This produces a homogenous mixture of supercritical carbon dioxide and rubber adhesive which is a sprayable composition.

More generally, this invention is predicated upon the concept of providing an apparatus for spraying viscous adhesive in which virgin adhesive and a supercritical fluid diluent, such as supercritical carbon dioxide, are thoroughly and substantially completely intermixed by a dynamic mixing device. In the presently preferred embodiment, the mixing device comprises a housing having a hollow interior formed with a first inlet for the supercritical carbon dioxide, a second inlet for adhesive which is located near the first inlet, and, an outlet spaced from the two inlets. A wire brush is placed within the housing interior, with its bristles preferably located in the space between the two inlets and the outlet. The opposite end or handle portion of the brush is connected to an air motor or other rotational device. The motor is operative to rotate the wire brush within the mixer housing so that in the course of passage from the inlets to the outlet of the housing the supercritical carbon dioxide and adhesive are intermixed to form an adhesive composition in which the supercritical carbon dioxide is substantially completely dissolved or dispersed in the adhesive to produce a sprayable composition. It is contemplated that paddles or other movable mixing elements could be utilized in place of the wire brush described above, provided that the adhesive undergoes sufficient agitation and shearing to enable the supercritical carbon dioxide to dissolve or disperse in solution within the adhesive.

In another aspect of this invention, a recirculation loop is preferably provided for continuously recirculating the adhesive composition from the outlet of the mixer, to the adhesive dispenser and then back to the second inlet of the mixer for combination with additional supercritical carbon dioxide. The recirculation loop is also connected to a source of virgin adhesive which selectively supplies additional adhesive to the loop as the spraying operation proceeds. A capacitance sensor is incorporated in the loop to provide a measurement of the capacitance of the adhesive composition which is indicative of the relative proportion or ratio of supercritical fluid and virgin adhesive within the adhesive composition. The capacitance of the adhesive composition is monitored to ensure it remains within a predetermined level to achieve optimum spraying conditions.

DESCRIPTION OF THE DRAWINGS

The structure, operation and advantages of the presently preferred embodiment of this invention will become further apparent upon consideration of the following description, taken in conjunction with the accompanying FIGURE which is a schematic depiction of the adhesive spraying system of this invention.

DETAILED DESCRIPTION OF THE INVENTION

For purposes of the present discussion, the term "adhesive composition" refers to adhesives having a relatively high solids content, i.e. on the order of at least about 10% to 40% by volume, wherein a portion of the solvent component within the adhesive is replaced with a fluid diluent such as supercritical fluid to reduce solvent emissions. The term "supercritical fluid" as used herein is intended to refer to a gas in a supercritical state above its critical pressure and critical temperature, wherein the gas has a density approaching that of a liquid material. It is also contemplated that liquified gases could be utilized in forming adhesive compositions, and it should therefore be understood that the term "liquified gas" may be utilized interchangeably with the term "supercritical fluid" in the foregoing description.

A number of compounds in a supercritical or liquified state can be intermixed with the virgin adhesive to produce an adhesive composition for spraying by the apparatus of this invention. These compounds include carbon dioxide, ammonia, water, nitrogen oxide ($N_2O$), methane, ethane, ethylene, propane, pentane, methanol, ethanol, isopropanol, isobutanol, chlorotrifluoromethane, monofluoromethane and others. For purposes of the present discussion, supercritical carbon dioxide is employed because of its nontoxic nature and because its critical temperature and critical pressure of 85° F. and 1070 psi, respectively, are well within the operating ranges of standard airless spraying systems including the apparatus 10 of this invention.

System Construction

Referring now to the FIGURE, the apparatus 10 comprises a supercritical carbon dioxide supply 12, a supply of virgin adhesive 14, a recirculation loop 16, an adhesive dispenser 18, and a dynamic mixer 20. These components of apparatus 10 are described individually below, and then their collective operation in forming and spraying an adhesive composition containing supercritical carbon dioxide is explained.

The supercritical carbon dioxide supply 12 comprises a tank 22, containing liquified carbon dioxide, which is connected by a line 24 to a filter 26. The liquified carbon dioxide passes through filter 26, and then through a line 28 into a pump 30. The pump 30 increases the pressure of the liquified carbon dioxide to a level above its supercritical pressure, e.g. preferably in the range of about 1200 to 1600 psi. The pump 30 is preferably a Haskell pump Model No. DSF35 commercially available from The Haskell Company of Burbank, Calif.

The pressurized, liquified carbon dioxide is discharged from pump 30 through line 32 into a heater 34, preferably of the type sold by Nordson Corporation of Westlake, Ohio, under the model No. NH4. The heater 34 is effective to raise the temperature of the liquified carbon dioxide to a level at least above the super-critical temperature of carbon dioxide, and preferably in the range of about 110° to 125° F. A relief valve 36 is connected to the heater 34 to act as a pressure release within the supercritical carbon dioxide supply 12, if required.

Having been pressurized and heated above the supercritical levels, the liquified carbon dioxide is converted to supercritical carbon dioxide upon discharge from the heater 34. The supercritical carbon dioxide is transmitted through a line 38 to a valve 40 which controls the flow of supercritical carbon dioxide into a supply line 42 connected to mixer 20. Preferably, the supply line 42 includes a one-way valve 44 to prevent flow of material from the mixer 20 in a direction toward the valve 40. The valve 40 is connected by a line 41 to a controller 120 which operates the valve 40 in the same manner as the computer and pulse generator circuit of U.S. Pat. No. 5,215,253 to Saidman et al., owned by the assignee of this invention, the disclosure of which is incorporated by reference in its entirety herein. As discussed in detail in U.S. Pat. No. 5,215,253, and as mentioned below in connection with an explanation of the operation of apparatus 10, the controller 40 employs a standard PID (proportional, integral, derivative) control algorithm to control the opening and closing of valve 40, and, hence, the quantity of supercritical carbon dioxide entering the recirculation loop 16.

In the presently preferred embodiment, the mixer 20 comprises a housing 46, formed with an interior 48, having a first inlet 50 connected to the supply line 42, a second inlet 52 connected to one end of recirculation loop 16, and, an outlet 54 connected to the opposite end of recirculation loop 16. The housing interior 48 receives a wire brush 56 having bristles 58 and a stem portion or handle 60. The bristles 58 of wire brush. 56 are preferably located within the housing interior 48 in the space between the second inlet 52 and the outlet 54, and, as depicted in the FIGURE, such bristles 58 extend across substantially the entire cross section of the housing interior 48. The handle 60 of wire brush 56 is rotatably carried by an internal bronze bearing 62 and an external bronze bearing 64 as depicted in the FIGURE. A portion of the handle 60 between the bearing 62, 64 receives a packing 66 preferably formed of tetrafluoroethylene or similar material capable of creating a seal along the brush handle 60 to prevent the escape of adhesive or supercritical carbon dioxide from the housing interior 48. The outermost end of handle 60 is connected by a coupler 68 to the output of a variable speed motor 70. The motor 70 is effective to rotate the wire brush within the housing interior 48 at a speed in the range of about 2,000 to 2,500 revolutions per minute which is monitored by a tachometer 71. In order to ensure that the motor speed is maintained within the desired range or at least above a minimum speed, the tachometer 71 sends a signal representative of the motor speed via a line 77 to a motor control 73, which, in turn, controls the operation of motor 70 as required.

In the presently preferred embodiment, the recirculation loop 16 comprises a line 72 connected to the outlet 54 of mixer 20 which, in turn, is connected to a capacitance cell 74 e.g. a capacitance sensing circuit of the type disclosed in U.S. Pat. No. 5,215,253 to Saidman et al., noted above. As discussed in U.S. Pat. No. 5,125,253, the capacitance cell 74 is effective to sense the capacitance of the material flowing therethrough, which, in turn, can be correlated to the relative proportion of supercritical carbon dioxide within such material. A meter 76 or other measurement device is connected to the capacitance cell 74 to provide a reading or indication of the capacitance of the material flowing through the recirculation loop 16 during operation of apparatus 10. The capacitance cell 74 is connected by a line 75 to the controller 120 for purposes explained in more detail below. The detailed construction and operation of the capacitance cell 74 forms no part of this invention of itself, and is therefore not discussed herein.

A line 78 extends downstream from the capacitance cell 74 and is connected by a branch line 80 to the adhesive dispenser. In the preferred embodiment, the dispenser 18 is a spray gun of the type sold by Nordson Corporation of Westlake, Ohio, under Model No. A7A. The dispenser or spray gun 18 is a recirculating type gun which discharges material through a recirculation line 82 back into the line 78 in the event the gun 18 is not operating. Preferably, a regulating valve 84 is located within line 78 between the branch line 80 and recirculation line 82 to divide the flow of material so that a desired amount of material is always circulating in the recirculating loop 16.

A back pressure regulator 86 is connected to line 78 downstream from the regulating valve 84 to maintain the pressure of the material within line 78 at a substantially constant level for supply to the dispenser or spray gun 18. A pressure monitoring device 88 is also connected to line 78, between the shut off valve 84 and back pressure regulator 86, to provide an indication of the pressure level within line 78.

The back pressure regulator is connected by a line 90 to a heater 92 preferably of the type sold by Nordson Corporation of Westlake, Ohio, under Model No. NH4. The purpose of the heater 92 is to maintain the temperature of the material within recirculation loop 16 at a level in excess of the critical temperature of supercritical carbon dioxide and, preferably, at a temperature in the range of about 110° to 120° F.

As depicted at the top of the FIGURE, virgin adhesive is transmitted from the adhesive source 14 into recirculation loop 16 through an adhesive pump 94 which may be, for example, a Nordson Rhino ® Model pump. The virgin adhesive is discharged from pump 94 through a line 96, which carries a shut off valve 97, directly into line 90 of the recirculation loop 16. Additionally, the adhesive pump 94 is connected by a line 95 to the controller 120 for purposes discussed below. In order to ensure that the virgin adhesive from pump 94 is transmitted to the heater 92, a one-way valve 98 is positioned in line 90 upstream from pump 94 to block the flow of virgin adhesive in a direction toward the pressure regulator 86. A pressure monitoring device 99 is connected to line 90 between the one-way valve 98 and pressure regulator 86 to monitor the pressure within line 90 at that location. Controller 120 is connected to this pressure monitoring device 99 via a line 101 as will be described below.

The heater 92 is connected by a line 100 to a high pressure pump 102, preferably of the type sold by Nordson Corporation of Westlake, Ohio, under Model HP. As depicted in the FIGURE, an accumulator 104 is connected by a line 106 to line 100 at a location between the heater 92 and. high pressure pump 102. The accumulator 104 is also commercially available from The Parker Hannifin Corporation, of Hillsborough, N.C., under Model No. BD05A214. The purpose of accumulator 104 is to dampen or smooth out any pressure fluctuations which may be present at the input to high pressure pump 102, which could be created, for example, when the adhesive dispenser or gun 18 is opened and/or when additional virgin adhesive is introduced into the recirculation loop 16 from pump 94.

The high pressure pump 102, in turn, is connected by a line 108 to a filter 110, preferably of the type sold by Nordson Corporation of Westlake, Ohio, under Model No. 109765. Filter 110, in turn, is connected by a line 112 to the second inlet 52 of mixer 20 thus completing the recirculation loop 16.

Operation of System

The method of operation of the apparatus 10 proceeds as follows. Initially, liquified carbon dioxide from tank 22 passes through the carbon dioxide supply 12 described above, where it is raised to sufficient temperature and pressure to form supercritical carbon dioxide downstream from the heater 34. The supercritical carbon dioxide is discharged from valve 40 through line 42 and past the one-way valve 44 into the first inlet 50 of the mixer 20.

During initial start up of the apparatus 10, virgin adhesive from pump 94 is introduced into the recirculation loop 16 by line 96 where it is heated to a temperature of about 120° F., and then directed by high pressure pump 102 through filter 110 into the second inlet 52 of mixer 20.

The virgin adhesive supplied by the pump 94 is highly viscous, and may have a solids content of 30% or higher. In order to thoroughly intermix the supercritical carbon dioxide with such viscous adhesive, the mixer 20 is equipped with a dynamic mixing device, such as schematically shown in the FIGURE. As noted above, the dynamic mixing device comprises a wire brush 56 having bristles 58 which are located between the second inlet 52 and the outlet 54 of the mixer housing 46. The supercritical carbon dioxide and virgin adhesive are introduced into the housing interior 48 through inlets 50, 52, respectively, where they come into contact with the bristles 58 of the wire brush 56. Preferably, the motor 70 is operative to rotate the wire brush 56, and, hence, the bristles 58, at speeds in the range of about 2,000 to 2,500 rpm. It has been found to be necessary that the wire brush 56 be rotated at least at a predetermined minimum speed. As noted above, the speed of motor 70 is monitored by tachometer 71 and controlled by the control 73 in response to a signal from tachometer 71. This control arrangement ensures that the motor speed remains above the predetermined minimum. As a result, the viscous adhesive is exposed to high, dynamic shear stresses and agitation ill the course of movement from the second inlet 52 to the outlet 54 of mixer 20. This enables the supercritical carbon dioxide to thoroughly intermix with the virgin adhesive, so that it substantially completely disperses into solution therewith. An adhesive composition is thus formed within mixer 20 comprising virgin adhesive and supercritical carbon dioxide which acts as a diluent to replace a substantial portion of the solvent content of the virgin adhesive.

The adhesive composition is discharged through the outlet 54 of mixer 20 and enters the recirculation loop 16 for transmission to the dispenser 18. In order to ensure that the adhesive composition has an appropriate ratio of virgin adhesive and supercritical carbon dioxide suitable for spraying, the relative proportion of supercritical carbon dioxide and virgin adhesive within the adhesive composition is monitored by the capacitance cell 74. The cell 74 provides a measurement of the capacitance of the adhesive composition moving therethrough which can be correlated to its supercritical carbon dioxide content. If capacitance cell 74 sends a signal to controller 120 via line 75 representative of a capacitance reading which is too low, controller 120 sends a signal through line 95 to turn on the pump 94 so that adhesive is added to the loop until the capacitance rises up into the acceptable range. If the capacitance cell 74 sends a signal to controller 120 representative of a capacitance level which is too low, the PID loop function of controller 120 opens valve 40 to allow supercritical carbon dioxide into the recirculation loop 16 until the capacitance reading therein drops down into the acceptable range.

A further control function provided herein involves a measurement of pressure within the recirculation loop 16. The pressure signal from pressure monitor 99 provides a continuous signal to controller 120. If the pressure drops below a minimum pressure setting, the signal through line 101 from pressure monitor 99 representative of such pressure level causes the controller 120 to turn on pump 94 so that additional adhesive is pumped into the recirculation loop 16 until the pressure climbs above the minimum setting.

The apparatus 10 of this invention is essentially continuous in operation, depending upon the requirements of a particular application. It is contemplated that upon initial start up of apparatus 10, the adhesive composition will be circulated within recirculation loop 16 for a period of time in order to ensure that sufficient supercritical carbon dioxide is present within the adhesive composition. Once the proper ratio of the components within the adhesive formulation is obtained, the spray gun 18 can be operated to spray adhesive composition onto a particular substrate. As the quantity of the adhesive composition within the loop 16 starts to become depleted, the flow of additional supercritical carbon dioxide and virgin adhesive into the recirculation loop 16 and mixer 20 is controlled by operation of the valve 40 and pump 94 as described above.

EXAMPLE

Acceptable spraying of a viscous rubber-based adhesive is obtained with an apparatus 10 of the type described above operating with the following parameters:

| | |
|---|---|
| Solids content of adhesive composition | 30% |
| Pressure in recirculating loop psi | 1200 to 1600 |
| Temperature in recirculating loop | 120° F. |
| Capacitance of formulation | 54 to 55 pF |
| Temperature of supercritical carbon dioxide at inlet 50 | 112 to 114° F. |
| Temperature at capacitance cell | 115 to 120° F. |
| Temperature at heater 92 outlet | 118 to 121° F. |
| Mixer speed rpm | 2000 to 2500 |

Under the above-identified operating conditions, a suitable spray pattern of adhesive is obtained.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Apparatus for spraying adhesive compositions, comprising:

a first supply for supplying supercritical carbon dioxide;

a second supply for supplying virgin adhesive;

a mixer having a first inlet connected to said first supply, a second inlet and an outlet, said mixer including a device for dynamically intermixing the supercritical carbon dioxide and virgin adhesive so that the supercritical carbon dioxide is substantially dispersed in solution with the virgin adhesive to form an adhesive composition;

an adhesive dispenser;

a recirculation loop connected to said second inlet of said mixer, to said outlet of said mixer, to said second supply and to said adhesive dispenser, said recirculation loop being effective to transmit adhesive composition from said outlet of said mixer to said adhesive dispenser for spraying onto a substrate, said recirculation loop transmitting virgin adhesive from said second supply to said mixer for intermixing with additional supercritical carbon dioxide and with adhesive composition which has not been discharged from said adhesive dispenser and which has been recirculated to said mixer to form additional adhesive composition.

2. The apparatus of claim 1 in which said mixer includes a housing having an interior which is formed with said inlet and said outlet, said device for dynamically intermixing comprising:

a wire brush located within said interior of such housing;

means for rotating said wire brush.

3. The apparatus of claim 2 in which said inlet and outlet of said mixer housing are spaced from one another, said wire brush being positioned in said space between said inlet and outlet and having bristles which at least partially span the cross section of said housing interior.

4. The apparatus of claim 2 in which said means for rotating said wire brush is a motor.

5. The method of spraying adhesive compositions, comprising:

transmitting virgin adhesive and supercritical fluid into a mixer;

dynamically intermixing the adhesive and supercritical fluid within the mixer interior by operation of a movable mixing element to cause the supercritical fluid to disperse in solution within the adhesive thus forming an adhesive composition;

transmitting the adhesive composition to a dispenser for spraying onto a substrate; and recirculating the adhesive composition which is not discharged from the dispenser through a recirculation loop to the mixer.

6. The method of claim 5 in which said step of recirculating the adhesive composition further comprises:

sensing the capacitance of the adhesive composition within the recirculation loop;

adding supercritical carbon dioxide into the recirculation loop in the event the capacitance of the adhesive composition is above a predetermined level.

7. The method of claim 5 in which said step of recirculating the adhesive composition further comprises:

sensing the capacitance of the adhesive composition within the recirculation loop;

adding virgin adhesive into the recirculation loop in the event the capacitance of the adhesive composition is below a predetermined level.

8. The method of claim 5 in which said step of recirculating the adhesive composition further comprises:

sensing the pressure of the adhesive composition within the recirculation loop;

adding virgin adhesive into the recirculation loop in the event the pressure of the adhesive composition is below a predetermined level.

9. The method of spraying adhesive containing bound rubber, comprising:

transmitting virgin bound rubber adhesive and supercritical fluid into a mixer;

dynamically intermixing the adhesive and supercritical fluid within the mixer interior by operation of a movable mixing element to form a sprayable adhesive composition;

transmitting the sprayable adhesive composition to a dispenser for spraying onto a substrate; and recirculating the adhesive composition which is not discharged from the dispenser through a recirculation loop to the mixer.

10. Apparatus for spraying viscous compositions, comprising:

a first supply means for supplying supercritical carbon dioxide;

a second supply means for supplying a virgin viscous material;

a mixer having a first inlet connected to said first supply means, a second inlet and an outlet, said mixer including a device for dynamically intermixing the supercritical carbon dioxide and virgin viscous material so that the supercritical carbon dioxide is substantially dispersed in solution with the virgin viscous material to form an viscous composition;

a dispenser;

a recirculation loop connected to said second inlet of said mixer, to said outlet of said mixer, to said second supply means and to said dispenser, said recirculation loop being effective to transmit the viscous composition from said outlet of said mixer to said dispenser for spraying onto a substrate, said recirculation loop transmitting virgin viscous material from said second supply means to said mixer for intermixing with additional supercritical carbon dioxide and with viscous composition which has not been discharged from said dispenser and which has been recirculated to said mixer to form additional viscous composition.

11. Apparatus for spraying viscous compositions, comprising:

a first supply means for supplying a liquified gas;

a second supply means for supplying a virgin viscous material;

a mixer having a first inlet connected to said first supply means, a second inlet and an outlet, said mixer including a device for dynamically intermixing the liquified gas and virgin viscous material so that the liquified gas is substantially dispersed in solution with the virgin viscous material to form an viscous composition;

a dispenser;

a recirculation loop connected to said second inlet of said mixer, to said outlet of said mixer, to said second supply means and to said dispenser, said recirculation loop being effective to transmit the viscous composition from said outlet of said mixer to said dispenser for spraying onto a substrate, said recirculation loop transmitting virgin viscous material from said second supply means to said mixer for intermixing with additional liquified gas and with viscous composition which has not been discharged from said dispenser and which has been recirculated to said mixer to form additional viscous composition.

12. The method of spraying viscous compositions, comprising:

transmitting a virgin viscous material and one of a supercritical fluid or liquified gas into a mixer;

dynamically intermixing the viscous material and said one of said supercritical fluid or liquified gas within the mixer interior by operation of a movable mixing element to cause the supercritical fluid or liquified gas to disperse in solution within the viscous material thus forming a viscous composition;

transmitting the viscous composition to a dispenser for spraying onto a substrate; and recirculating the viscous composition which is not discharged from the dispenser through a recirculation loop to the mixer.

* * * * *